US005955236A

United States Patent [19]

Bower

[11] Patent Number: 5,955,236

[45] **Date of Patent: *Sep. 21, 1999**

[54] LIQUID TONER AND IMAGING SYSTEM

[75] Inventor: Michael D. Bower, Carver, Mass.

[73] Assignee: Delphax Systems, Canton, Mass.

[ * ] Notice: This patent is subject to a terminal disclaimer.

[21] Appl. No.: 09/016,161

[22] Filed: Jan. 30, 1998

Related U.S. Application Data

[63] Continuation of application No. 08/691,465, Aug. 2, 1996, Pat. No. 5,763,131.

[51] Int. Cl.[6] ..... G03G 9/135

[52] U.S. Cl. ..... 430/115; 430/126

[58] Field of Search ..... 430/115, 126

[56] References Cited

U.S. PATENT DOCUMENTS

| | | | |
|---|---|---|---|
| 4,842,972 | 6/1989 | Tavernier et al. | 430/117 |
| 4,869,982 | 9/1989 | Murphy | 430/48 |
| 5,300,390 | 4/1994 | Landa et al. | 430/115 |
| 5,763,131 | 6/1998 | Bower | 430/115 |

*Primary Examiner*—John Goodrow
*Attorney, Agent, or Firm*—Lahive & Cockfield, LLP

[57] ABSTRACT

A toner for electrographic printing includes a liquid carrier and a release agent added to the carrier to reduce the amount of carrier leaving the developer section, thus allowing operation at higher speeds and reducing the time and energy required for carrier removal in subsequent sections. An imaging system, or unit of an imaging system, and a method of imaging employ an imaging member such as a belt to form a liquid-toned image, to condition the image, and to transfer it to a print-receiving medium. The member moves through several sections, and transports liquid toner out of an image-developing section. In a preferred embodiment the release agent wets the imaging member, and has a higher boiling point than the carrier and a lower surface tension, though its viscosity may be higher. The release agent reduces carrier entrainment, and coats the imaging member, also enhancing transfer of the final print image. It may also counteract aging characteristics of the imaging member.

28 Claims, 5 Drawing Sheets

LIQUID TONER AND IMAGING SYSTEM

This application is a continuation of U.S. Pat. No. 5,763,131 issued on Jun. 8, 1998 based on U.S. application Ser. No. 08/691,465 filed on Aug. 2, 1996.

BACKGROUND OF THE INVENTION

The present invention relates to imaging systems of the type wherein a latent charge image is formed on an imaging member, the latent charge image is developed by a toner, and the developed image is transferred to a receiving member to form a permanent image. Numerous systems of this type exist in the prior art, wherein the latent image is formed by optical or electrical means, and the pigmented toner is a liquid toner or a dry powder toner. The present invention specifically relates to liquid-toned systems.

Any imaging system is subject to broad limitations that affect system performance.

Suspension of the pigment particles in a liquid carrier allows a high degree of process uniformity, and permits the use of very fine toner particles, so that extremely faithful images may be produced when specialized processors or recording sheets permit operation, generally at relatively low speeds, without squeegee or pressurized wet image transfer steps. On the other hand, liquid-toned images may become blurred or distorted during transfer, and may also require special coated papers so as not to soak into, or through, the receiving member. Undesirable wicking along paper fibers may degrade the final image, and environmental concerns are raised by the presence of vapors from the toner carrier, which is generally transferred to the imaging member and partially removed during a fusing step.

Dry toners on the other hand are convenient to handle, and are essentially free of vapor emissions, but they present other limitations related to their development mechanics. The use of generally larger toner particles in dry toners is necessary to limit environmental dust, but can give dry-toned images of low density a grainy appearance; and the mechanical application by cascade or a brush rotating along the sheet feed direction may give rise to small directional artifacts, such as streamers, or background fogging in the final image. Furthermore, development efficiency can become extremely variable as the components of a multi-part developer vary, or as weather conditions that affect charging of the member or transfer of the toner, change.

As demands for greater speed or resolution, or decreased environmental impact, are placed upon such imaging machines, each kind of process is increasingly challenged, and no single design can be expected to simultaneously optimize operating cost, cleanliness, resolution, speed, mechanical simplicity and component lifetime.

Among the greatest problems in such imaging mechanisms are those of forming a toned image, keeping it stable, and transferring this image to the ultimate print sheet (or fixing it on the sheet, in those specialized systems in which the ultimate sheet is directly developed) with speed and good image quality.

In a liquid toned system, transfer to the final sheet may be accomplished by direct contact, in which the liquid and toner particles are simply wicked into the partially absorbent receiving surface. In a powder toned system, the powder-developed image may be transferred by a high pressure nip, or may be transferred by providing electrostatic field at the nip or gap with an imaging roller. Often, specialized intermediate transfer belts or drums are used to pick up the toned image from the latent imaging member and then release it to a recording sheet. Fusing of the transferred image may be accomplished later by applying heat, pressure or both.

Some systems extend across different ones of the above categories. For example, commonly-owned U.S. Pat. Nos. 5,012,291 and 5,103,263 show a belt system wherein a powdered toner is applied to the imaging belt and then brought to a high temperature or even liquefied state on the belt before being brought into contact with a receiving sheet. Commonly-owned U.S. Pat. No. 5,414,498 shows a similar system in which a liquid-toned image is heated on the imaging belt to drive off carrier and change state to a dry image before transfer. U.S. Pat. No. 4,708,460 shows a system where a liquid-toned image is transferred to an intermediate belt 34 that carries it through a heater station, partially vaporizing the carrier and softening the toner particles before the liquid image is transferred and fused at a hot pressure nip, where substantially all the remaining carrier liquid is vaporized. A somewhat similar system intended for multicolor printing is shown in U.S. Pat. No. 4,690,539, wherein liquid images of successive colors are transferred to an intermediate belt on which the carrier from each color step is removed by a vacuum system, thus stabilizing the toners on the belt before transferring the dried toner images to a copy sheet. In each of these latter systems, some or all of the carrier is removed before the image is transferred to a final recording sheet.

U.S. Pat. No. 5,106,710 shows a system wherein one or more liquid toner images are applied to a dielectric-coated paper with a thin release coating. The toned image passes a vacuum squeegee, and is air dried after which the toner image is transferred to a receiving sheet in a heated roller nip or on a hot platen in a vacuum draw-down frame.

Other processes have been proposed several decades ago wherein liquid toners are partially or fully dried, as part of a multicolor liquid-toned process, on an imaging member, and recently very specific systems have evolved, such as the one shown in international application WO91/03006 wherein an intermediate roller member is used to pick up a liquidtoned image, heat it and transfer to a recording sheet. Effective transfer in such systems may depend on the temperatures and surface properties of each of the various sheets and rollers, as well as the viscosity of the image at its transfer nip.

SUMMARY OF THE INVENTION

In accordance with the present invention, a single imaging member receives a latent image and is developed at a first station with a liquid toner containing a carrier, a pigment and a release agent, to form a toned image on the member. The release agent limits the amount of carrier entrained by belt.

In this system, the temperature is raised to a drive off the carrier liquid, after which the heated dried toner is transferred, for example, by direct contact, and fused to a receiving member. The liquid toner may have hard thermoplastic toner particles suspended in the carrier, with a charge director, and preferably the particles are non-swelling in the carrier. The release agent is an inert low surface tension liquid which is soluble in the carrier but has a high boiling point, so it both wets the belt and remains on the belt surface, i.e.,evaporation of the carrier leaves residual release agent. The dry friable but captive powder image on the surface of the imaging member then transfers fully and effectively to the print or other receiving member. Preferably, the image is transferred at a temperature above its melting point.

In one embodiment, the member is a belt that moves over rollers at each end, and a heating enclosure surrounds a central portion of belt, where optionally a heat exchanger scavenges heat from a returning dry portion of the belt to evaporate carrier from the toned wet portion of the belt as it travels toward the heated transfer station. The release agent constitutes under seven percent and generally between about 0.05 percent and two percent by weight of the carrier, and is a silicone, fluorosilicone or similar agent which is electrically insulating. The belt is inextensible, but may include a relatively compressible elastomeric upper layer to allow it to conform when transferring the heated image to diverse print objects, such as cans or packaging, textured sheets, or other articles on which an image is to be printed. Preferably material of the belt is non-swelling and resistant to the carrier. A solvent barrier may be formed at the belt surface, by coating, applying cross-linking energy, or otherwise adding or altering a thin layer, to protect the belt from absorbing carrier. In this case, the release agent may further be selected for its similarity to or compatibility with the surface layer, to replenish or recondition surface species or surface characteristics which change as the belt ages.

BRIEF DESCRIPTION OF THE DRAWINGS

These and other features of the invention will be more fully understood from the following description, taken together with illustrative drawings, wherein.

Detailed Description

Figure 1:
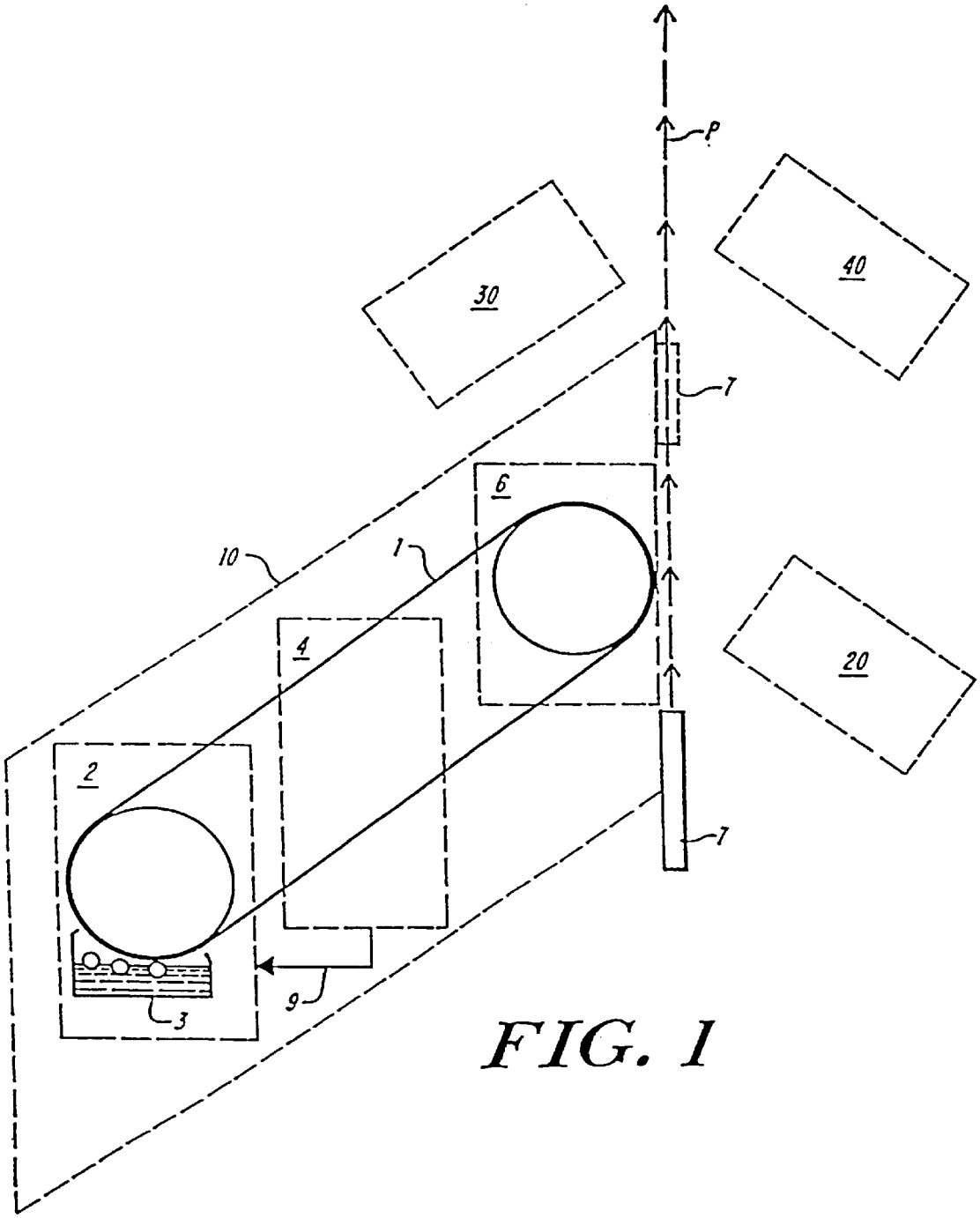
FIG. 1 is a simplified schematic diagram of a print system for practice of the present invention.

A representative print system 10 for practice of the present invention includes an imaging member 1, shown as a belt in FIG. 1, which passes in an endless loop through three distinct stations for forming, conditioning and transferring a toned image carried by the belt. In the first section, image formation section 2, a latent charge image is formed on the belt, and is toned by a liquid development unit 3 with a specially compounded liquid toner, described further below. The belt then passes through an image conditioning section 4 where its temperature is raised and carrier is extracted from the toned image and returned to unit 3. As described further below, the liquid toner is specially compounded with a release agent that substantially reduces the uptake of carrier, i.e. the amount of carrier on the belt as it leaves the development unit 3, thus greatly facilitating and enhancing the efficiency of subsequent carrier removal steps. Preferably the release agent has a high boiling point, and as the image on the belt dries, a small amount of release agent remains, while the volatile recovered carrier fluid is returned to the imaging section 2 along return 9. The belt then passes to a transfer section 6, where the substantially dried powder image is transferred in a heated "transfuse" step to a print image receiving member 7.

Member 7 may be a sheet or a continuous web, or as explained more fully below, may be an article, such as a can, box, package or tile which requires printed text or graphics, or may comprise an intermediate drum or belt which receives and carries the toner image to such a final article. Similarly, the system may include other units 20, 30, 40 identical to system 10, which are arranged about the transport path P of receiving member 7, to print additional colors, or to print on the opposite side of member 7. For example, a single-pass four-color, two-sided printing system would have eight such units 10, . . . 80, arrayed four on each side of the path, of which only the first few are shown in FIG. 1.

Figure 2:
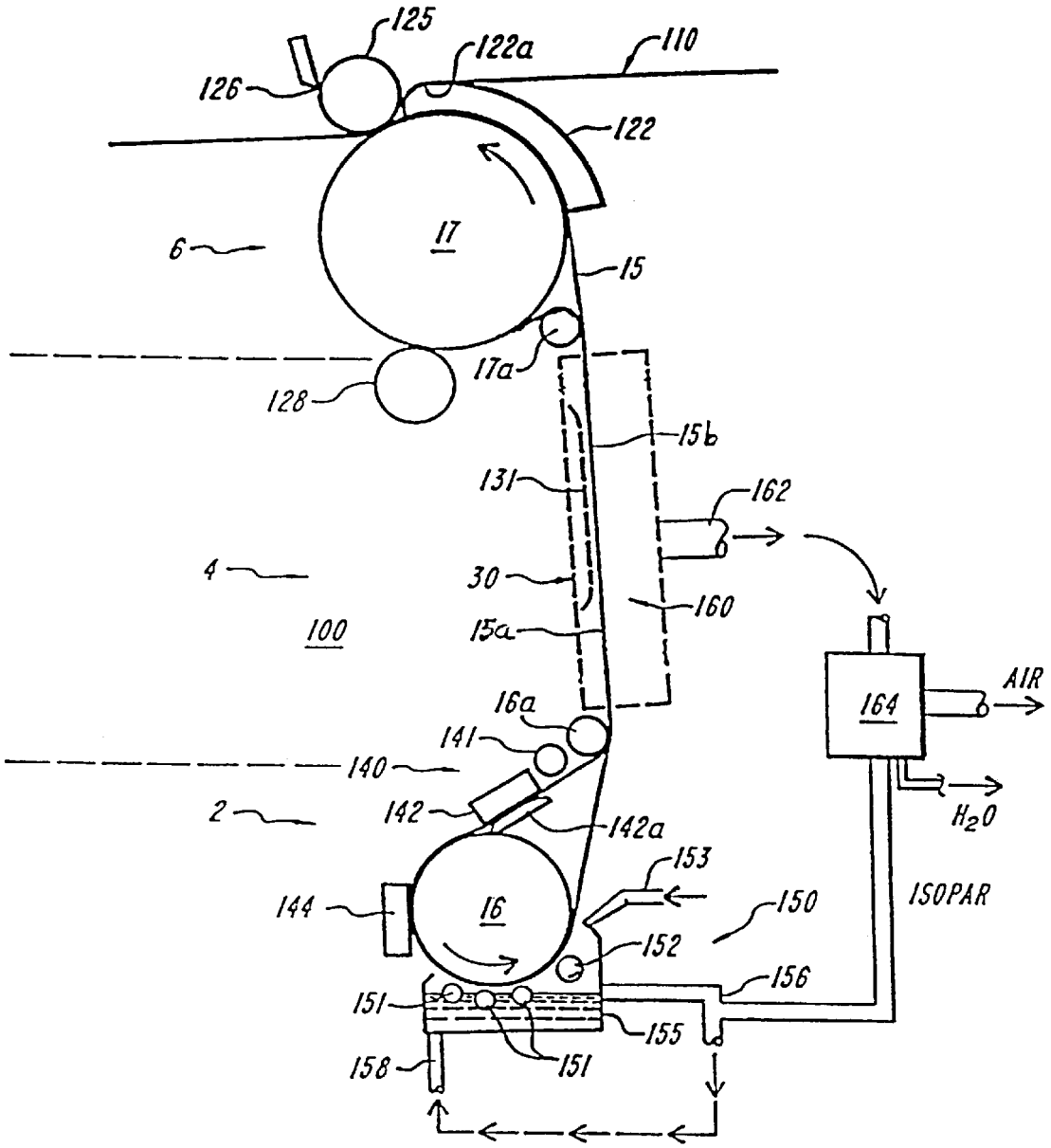
FIG. 2 illustrates one embodiment of a liquid-toned printer as in FIG. 1 employing the invention.

A preferred embodiment 100 of a basic single-toner printer employing the toning system is illustrated in FIG. 2. Printer 100 includes a dielectric or photoconductive imaging belt 15 that is charged by a latent imaging print cartridge 144. The mechanical layout of this system bears many points of similarity to that of a powder-toned printing system described in commonly-owned U.S. Pat. Nos. 5,012,291 and 5,103,263, in that the image-forming and image transfer stations are located at opposite ends of an endless imaging member, with pre-heating effected at an intermediate portion before transfer, and in some embodiments the intermediate portion effects this pre-heating at least in part by heat exchange between two different portions of the imaging belt. The reader is referred to those two patents for details of such a system and the construction of inextensible and elastomeric belts of suitable imaging properties and capacity. The reader is further referred to commonly-owned U.S. Pat. No. 5,414,498 for a description of such a belt system suitable for a liquid printing system. These three patents are all hereby incorporated by reference herein in their entirety.

The charge retaining imaging belt 15 shown in FIG. 2 may be a photoconductive belt or a dielectric belt, and it receives a patterned charge image from imaging module 144 and tones that image in a liquid toning unit 150. Toning unit 150 comprises a housing 155 holding a reservoir of liquid toner, and several counter-rotating toner applicator rolls 151 which apply liquid toner to the rotating belt across a small bias field in a gap of under one-half millimeter. A squeegee or skiv roll 152, air knife 153, or both remove excess toning liquid. The toning unit is maintained at a slight negative pressure to prevent release of fumes, and a circulation pump operates continuously between an outlet 156 and an inlet 158 to keep toner particles uniformly suspended in the carrier. After passing through unit 150, the portions of the belt charged by the print cartridge or imaging module have a thin film liquid toned image thereon, which is then carried by the belt to the image conditioning section 4.

Applicant has found that an effective and uniform application of the liquid toner to the imaging belt 15 is achieved by maintaining the gap between developing rolls 151 and the belt at about one-tenth millimeter, while effective maintenance of a thin and continuous meniscus ahead of the squeegee roll 152 is achieved with a gap approximately half that size. When employing a larger gap, a spray bar may be positioned ahead of the squeegee roller to assure that the meniscus is continuous. The squeegee roll counter rotates at about the same surface speed as the imaging belt or higher, removing excess liquid by a controlled shear of the deposited developer carrier layer.

Looking ahead briefly, the belt 15 next carries the toned image into an enclosure 160 where it is heated to drive off the liquid carrier, leaving a substantially carrier-free toner image, and this image travels to and is transferred, or "transfused", by hot pressure contact at the upper roll 17. Thus, the three sections 2, 4, 6 of FIG. 1 correspond to three distinct states (in the physico-chemical sense, i.e., liquid, dry and fused/vaporized) of the toned image or its components. As discussed in the above-referenced '498 patent, the surface properties of the single image receptor belt and toner properties are correspondingly particularized for receiving, holding and releasing this toner image.

Initially, in the imaging/toning section 2 the image consists of pigment/binder particles and the release-modified carrier liquid. The liquid component is a non-conductive dielectric medium, and forms a film on the belt which serves to efficiently and uniformly carry toner particles to charged imaging sites of the latent image. Unlike the case of dry powder toning systems, it is not necessary for the belt to have a hard surface, since there is no direct pressure exerted on the belt surface that might embed toner particles. Thus, the imaging/toning section 2 imposes no significant constraints on the imaging belt and toner beyond those of conventional elements.

However, in accordance with a key aspect of the present invention, applicant has found that a marked decrease in the amount of carrier entrained by the belt as it leaves the toning section 2 is achieved by adding a small quantity of release agent, such as a silicone-based fuser oil, to the carrier. Since as described further below, the subsequent removal of this carrier is an energy-intensive and time-sensitive step of the overall print process, this unexpected reduction of carrier consumption achieved by the addition of release agent is a significant improvement.

Continuing with a description of FIG. 1, in section 4, heat is applied to the toned image residing on the belt, and carrier liquid from the toner is driven off. In this section, a very high degree of carrier drive-off is effected, and both the belt and the toned image are subjected to heating. Suitable carriers for liquid toning may be selected from light paraffin mineral spirits such as the Isopar series marketed by Exxon, generally from among the Isopar G to Isopar L weight series. The carrier should have a relatively low surface tension so that it can wet the belt 15, and should have a reasonably low boiling point, e.g., about 160° C. to allow effective drying during a relatively short time of belt rotation. Furthermore, unlike conventional emulsion-like liquid toners, the toner particles are preferably selected to be a thermoplastic material that is non-swelling and substantially insoluble in the Isopar carrier. This assures that the wet image, rather than substantially increasing its viscosity in section 4 and retaining carrier as it is heated, dries. Suitable insoluble and non-swelling toner particle materials and methods of making suitable toners are disclosed, for example, in U.S. Pat. Nos. 5,069,995 and 5,045,425 of Ronald Swidler. It will be understood that the materials of belt 15 are to be formed of an Isopar-resistant material, such as a fluorosilicone material, or are treated to resist the carrier. A hard or highly cross-linked surface layer as disclosed in U.S. Pat. 5,012,291 may be used as a barrier layer to minimize absorption by the belt of the Isopar carrier. Thus both the belt and toner have special properties for the operation of section 4 described herein.

Finally, in section 6, the dried toned image is transferred in a heat-soften state to the receiving member. Thus, the carrier changes state from liquid to vapor phase in section 4, while the powder changes or has changed its state, substantially softening or attaining its glass transition temperature $T_G$ at the pressure transfer/fusing section 6. As described in the aforesaid co-owned '498 patent, the belt surface has a low surface free energy, so that the heated image is released as the tacky softened toner contacts the image receiving sheet or article 7; the belt also has a sufficient elastomeric softness to fully conform to the receiving surface. As set forth in the above-referenced commonly-owned patents, a 0.05 mm thick layer of a twenty to fifty Shore A durometer elastomer, overcoated with a thinner, harder surface layer, has been found serviceable for hot transfuse imaging onto fiber-based papers. For transfer to a smooth or compliant intermediate member, such as a silicone rubber image transfer roller, a relatively hard TEFLON coated polyimide imaging belt, without any elastomer layer, may be used.

It should be noted that because the image is not originally a powder image but a liquid one, clumping of particles is not a problem, and the component of thermoplastic material used in forming toner particles for transfuse imaging may therefore be selected to have a quite low softening range, preferably in the range of approximately 80–100° C. Thus the liquid-toned printer architecture, by relaxing this constraint on the toner properties, allows operation with a low-fusing composition, a feature which in itself can produce significant energy savings. Furthermore, by employing a belt surface coating with a low surface free energy, under approximately twenty ergs/cm$^2$, the surface is not substantially wet by the carrier fluid per se, and relatively little of the carrier fluid is carried out of the first, toning, section 2. A fluorosilicone belt coating, selected to be non-swelling in the Isopar solvent carrier, may be used. Alternatively, an 0.025 mm FEP Teflon coating, such as that sold or applied under the mark Xylan by the Whitford Corporation may be used. However, as discussed further below, it is important that a uniform and sufficient amount of toner be picked up by the belt to maintain a continuous film. Thus the belt surface faces several competing constraints of toner contact and uptake, and image release properties.

Various representative elements of the heated solvent removal section 4 such as a heat transfer back plate 131 in an enclosed region or chamber 160, and a condenser 164 to return carrier to the toning unit 150 are illustrated in FIG. 2, as well as knee rollers 16*a*, 17*a* to position the counter-moving portions 15*a*, 15*b* of the belt. Such elements are optional and may be employed as necessary to influence the speed or efficiency of the drying stage 4. Continuing with a description of FIG. 2, as the belt passes through the heated image conditioning chamber 160, the Isopar carrier is substantially entirely driven off, leaving a dried toner powder image on the warmed belt. As the belt reaches the upper roller 17, it is pressed into contact with an image receiving members illustratively a paper web 110, to which the heated powder image is simultaneously transferred and fused. At this stage, the toner is heated above its glass transition temperature, so it is tacky when pressed, and preferentially binds to the receiving member, and flows into the receiving sheet if it is fibrous, firmly and uniformly adhering to the image areas. Because of the relatively low thermal mass of both the belt and the toner image it carries, it is desirable to heat the receiving member 120 before it contacts the belt. In the FIGURE, this is accomplished by drawing the sheet 120 over a heated face 122*a* of a heater 122; heater 122 may also heat the roller 17, or internal heaters may do so. Image transfer occurs at the nip between a pressure roller 125 and roller 17.

In the illustrated embodiment, a scraper 126 may be provided to maintain the pressure roller 125 clean, and a cleaner assembly 128 having an absorbent or adhesive surface may contact the belt 15 to pick up any untransferred residual toner, so that the portion of the belt 15*a* leaving the roller 17 is clean and ready for further imaging operations. However, the residual release agent on the belt assures that in practice, virtually one hundred percent of the toner is transferred to the receiving sheet. The scraper and cleaner assembly serve primarily to remove paper dust and the like from the belt and roller. As described in the aforesaid '498 patent, knee rollers 17*a*, 16*a* may position the counter-moving portions of the belt 15*a*, 15*b* in heat-exchange contact if greater heat efficiency is desired. Alternatively, heat transfer rollers having a thin thermally-conductive skin, as known from fusing belt construction, may be placed in rolling contact between the counter-moving heated and unheated portions of the belt Next, or after moving through the heat exchange region, if one is provided, the cleaned and cooled belt portion 15*a* passes on to an electrostatic imaging area 140 where a corona discharger, e.g., a corona rod 141, erases the residual belt surface charge distribution. The belt then passes to one or more controllable print heads 142, 144 or other imaging units which selectively deposit or leave an image-wise charge distribution on the moving belt so that toner next applied by applicator 108 will adhere to the belt with a spatial distribution corresponding to the desired image. In the prototype embodiment, the printhead 144 is a charge transfer printhead of the general type shown in U.S. Pat. No. 4,160,257 and later patents of Delphax Systems. Printhead 144 may, however, comprise an ion-flow cartridge, an electrostatic pin array or other latent-image charge applying means, or in the case of a photoconductive belt, may comprise a laser scanning or imaging module, or a laser diode array which is actuated to selectively discharge a uniform potential which has been previously established, for example, by the corona rod 141, a charging brush or equivalent assembly.

The two latent image depositing printheads 142, 144 illustrate two different approaches to mounting a printhead in relation to the belt. Printhead 144 is opposed to the drum 6, whereas printhead 142 is positioned opposite an anvil 142*a* against which the belt is urged. Anvil 142*a* is shaped to provide a desired surface flatness, or a specific curvature which may be selected to compensate for charge drop-off or dispersion (or light dispersion for an LED printhead) of the printhead in the circumferential direction, so that the belt receives a uniform charge at each dot formed by printhead 142. The described dielectric belt system is thus adapted to generate latent charge images by the placement of plural lightemitting or charge transfer printheads at arbitrary positions along the belt ahead of the toner applicator 150. In practice a single printhead, e.g., printhead 144, is sufficient for single-tone or single-color printing, and may even be used to form multicolor images by forming an extended range of charge potentials, and biasing several toning reservoirs to apply different color toners to regions of different potential on the belt.

As noted above, one aspect of the belt construction which is important to the operation of the printing apparatus relates to the toner pick-up and release characteristics of the belt. These attributes will be discussed with reference to an electrographic printhead structure such as shown in U.S. Pat. Nos. 4,155,093, No. 5,014,076 and elsewhere, which, in accordance with general principles known in the art, operates by depositing a latent image charge formed by projection of charge carriers (e.g., ions and electrons) onto a dielectric member such that a charge of up to several hundred volts is deposited at each image point of the member for attracting toner particles to the dielectric member and developing a visible image.

For operation with such a print cartridge, applicant has employed a nonconductive belt with a conductive backplane, the non-conductive portion being a dielectric with a capacitance of approximately 400 pf/cm$^2$. In general, a preferred range for other common charging and toning systems is generally in the range of 50 to 500 pf/cm$^2$, although for certain systems, such as one with a stylus-type charging head, a higher belt capacitance of approximately 1000 pf/cm$^2$ may be desired, while for other systems operation with a belt capacitance as low as 10 pf/cm$^2$ may be feasible. The construction of a preferred belt having a capacitance of 400 pf/cm$^2$ falling within such capacitance range is discussed in greater detail below, following consideration of toner release characteristics.

Transfer of the dried image is achieved in part by providing a surface layer of low surface energy and of sufficient softness to conform to the print object, so that when the toner is heat-softened or melted, and mechanical pressure is applied, the toner globs do not wet the belt and when it fully contacts the receiving sheet it is transferred to the paper or other receiving material. A belt surface formed of a low surface free energy material advantageously prevents excessive toner in its liquid state from remaining on or sticking to the belt surface. This also assures that the belt does not retain toner particles in the absence of the applied latent image charge, or retain toner at the transfuse section 6 in the presence of the mechanical adhesion or "wicking" of the viscous heated toner to paper. This also limits to some extent the wetting that can occur in the development section 2, and with toner particles which are also insoluble and non-swelling on the carrier, relatively little Isopar is transported into the heat exchange/drying section 4, either by the belt or the toner particles.

By way of example, suitable elastomeric properties of the belt may be obtained with an elastomeric layer approximately 0.05 mm thick of an Isopar-resistant rubber of a 30 Shore A durometer formed on a polyimide, or polyamide/imide belt material, e.g., a continuous loop of KAPTON or other inextensible belt body.

Other suitable materials for the inextensible portion of the belt substrate may include 0.05 mm thick films of Ultem, or other relatively strong and inextensible web materials such as silicone-filled woven NOMEX or KEVLAR cloth, capable of operating at temperatures of up to approximately 200° C. For a direct belt-imaging construction, suitable conductive material may be included in or on the substrate layer to control charging and provide a ground plane behind the latent-image receiving surface. Suitable elastomeric layer materials may include dielectric silicone rubbers, fluoroelastomers, including fluorosilicones, fluoropolymers such as VITON, and other moderately heat-resistant materials having a hardness preferably in the range of about 20–50 Shore A, and a resistance to the selected toner carrier. Because the belt is not subjected to a pressure nip at any point where dry toner powder is present, the hard coating described in the aforesaid commonly assigned patents is not essential, although it may be expected to enhance belt lifetime, and improve its Isopar resistance. Furthermore, when intended solely for transferring to a smooth surface substrate, such as plastic film, or to an intermediate roll, it is not necessary that the imaging belt have an elastomeric layer. Instead, a single low surface energy coating, such as an FEP Teflon coating ten to twenty microns thick may be applied to the inextensible polyimide belt.

As more fully described in the above mentioned co-owned patents, the belt may also have its photoconductive, dielectric and/or hardness properties enhanced by use of one or more filler materials in the belt, e.g., in the elastomeric layer. For example, finely divided metal powders may be employed in a low concentration to greatly increase the belt capacitance, without significantly affecting its conductivity; or photoconductive powders may be added to adapt the belt to a light-imaging process.

The above described printer picks up a layer of liquid carrier as it rotates through the development station, and this layer is kept as thin as possible by the skiv or squeegee roll 152 (FIG. 2), so as to decrease the overall time and energy requirements for carrier removal. The low surface tension and viscosity of the Isopar carrier, coupled with the low surface energy of the coating help to minimize the thickness of the developer layer on the belt. In practice, a skiv roll spacing of 0.05 mm has been found effective to maintain a meniscus ahead of the roll and strip excess carrier without impairing the toned image. The skiv roll rotates at about the same surface speed as the belt, but in the opposite sense, to create a high speed shear of the fluid held on the belt surface.

As described above, the system is substantially similar in its mechanical structure to that of applicant's '498 patent, but utilizes a toning formulation that not only contains a liquid carrier and pigmented toner particles, but also includes a minor amount of a release agent which is soluble in the carrier. The agent is less volatile than the carrier and of lower surface tension, so some release agent remains on the belt after removal of the carrier. The residual release agent may lower the temperature required for the dried image to be dependably and completely released to the print receiving sheet, allowing both the drying and transfer steps to operate with the lower energy usage.

In addition to being a liquid of low surface tension, soluble in the carrier and having a boiling point substantially above that of the carrier, the release agent is electrically insulating. One suitable release agent is an inert silicone oil such as the Dow Corning 200 Fluid sold by the Dow Corning company for use as a fuser oil. A number of fluorinated oils are also expected to work. With the Dow fuser oil, a range of 0.05% to about 2% by weight of oil with a viscosity of 20 cStokes was mixed with the carrier, with effects varying as will now be described.

Figure 3:
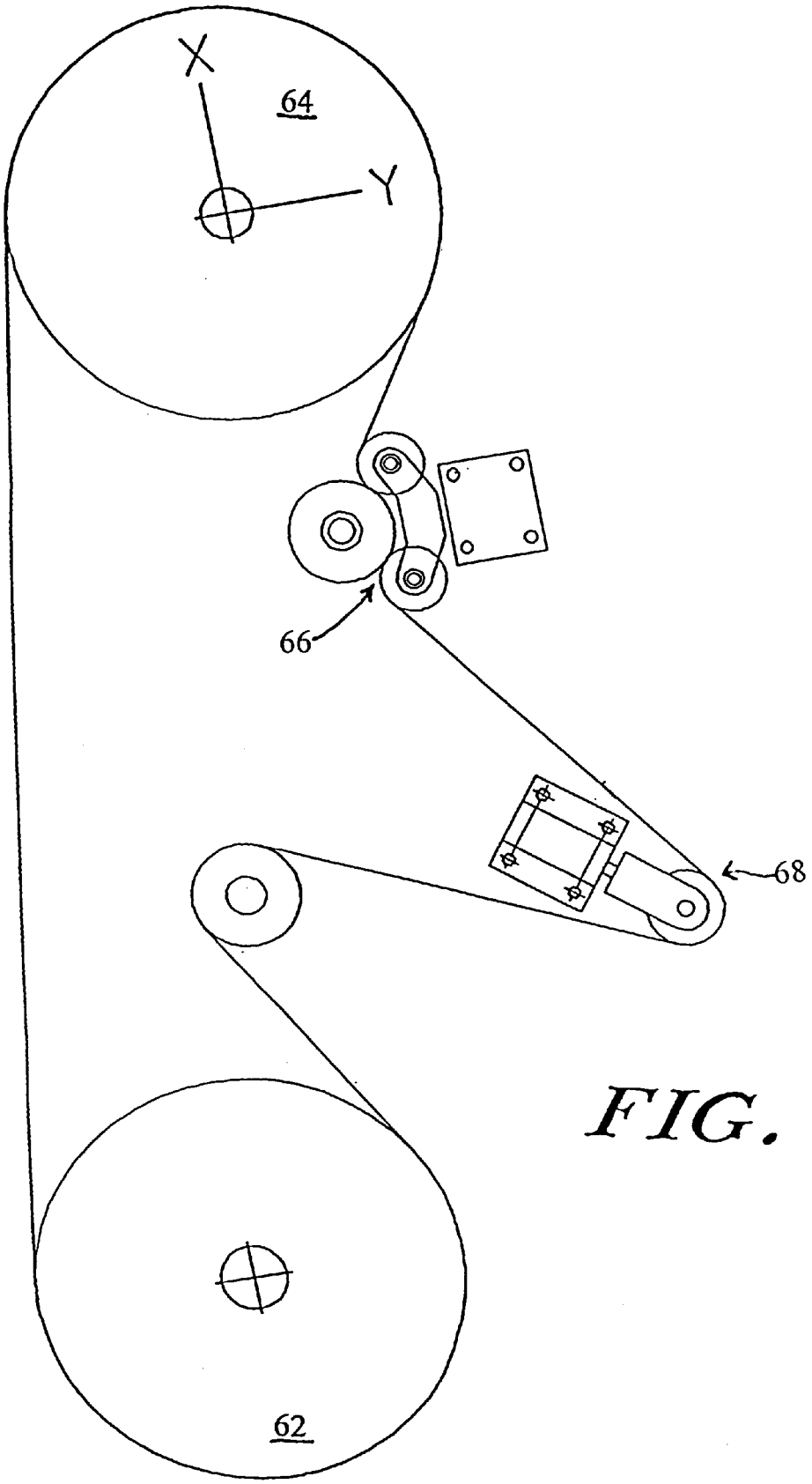
FIGS. 3 and 3A illustrate an experimental system used to evaluate toner formulations of the invention.
Figure 3A:
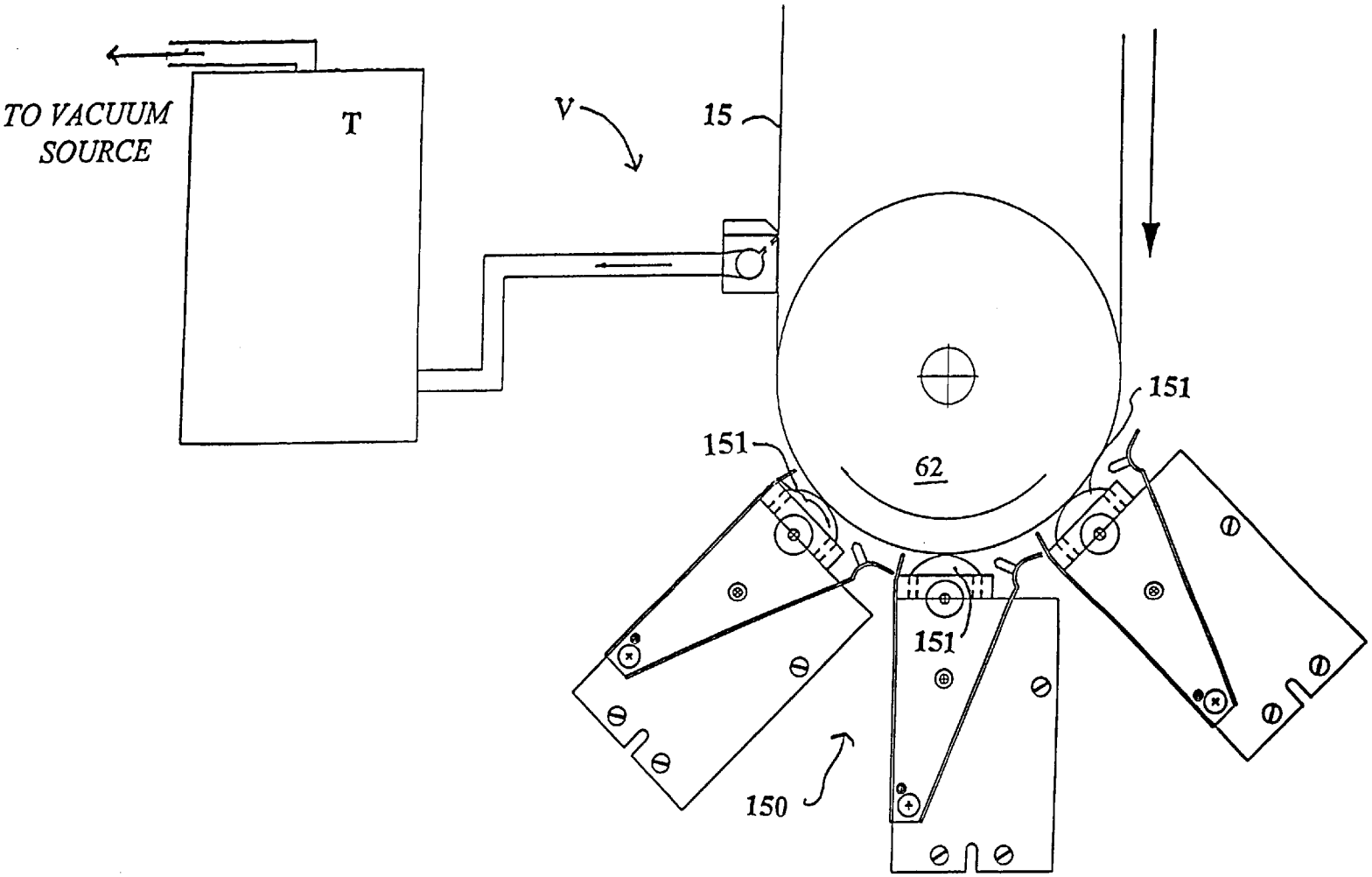

To quantify the amount of carrier being carried out of the developing unit with each pass of the imaging belt, applicant performed a series of experiments using a liquid toner modified with different quantities of a release agent, wherein an imaging belt was run continuously past the developer rolls and was dried with a vacuum system V to gather all the carrier emitted in the carrier extraction section 4 into a closed tank T, which was packed with absorbent towels. The towels were weighed before and after each run, so the change in weight of the towels represented the amount of Isopar that had been entrained by the imaging surface and carried past the skiv roller during the test period. A configuration as set forth in FIG. 3 was employed with an eighty-four inch long loop 15 maintained centered and tensioned over end rollers 62, 64 by a tensioning idler assembly 66 and a web guide assembly 68. As shown in FIG. 3A, the developer assembly 150 was positioned about the lower roll 62. In measuring carrier uptake of the toner so modified, applicant found that this use of a release agent in the liquid carrier reduced the amount of carrier which adheres to the belt as it leaves the developing unit. This enhanced the overall process by reducing the load on the drying section 4, and may also be expected to reduce overall carrier emission levels.

A constant imaging speed of thirty inches per second was used for the imaging member, with both the first and second developer rolls rotating at a ten percent faster surface speed across a 0.125 mm gap. The counter-rotating skiv roller was spaced 0.05 mm from the belt by ceramic spacers to provide a small but precise shear gap for stripping excess toner, and was operated at different speeds between about thirty-five and seventy inches per second. An Isopar supply flow of six cc per second was provided to the first developer roll, and the belt was run continuously for sixty seconds in each test. Under these conditions, applicant varied three operating parameters while measuring total Isopar transport, as follows:

i) the skiv roll speeds varied between 35 and 70 ips;

ii) the printer was run with and without a spray bar operating ahead of the skiv roll; and iii) the printer was run with and without a silicone oil release agent mixed in the carrier.

Figure 4:
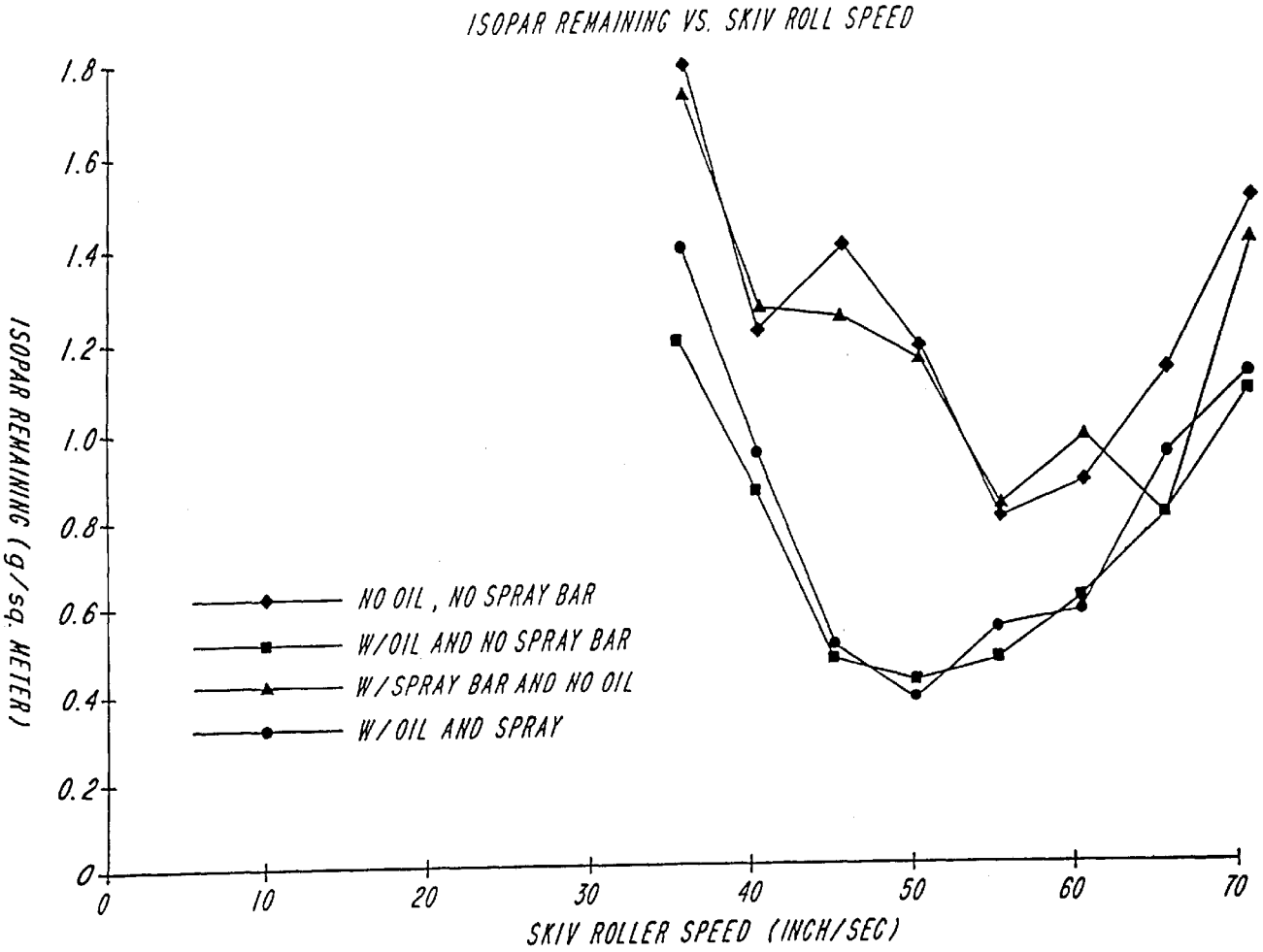
FIG. 4 illustrates carrier uptake with the described toner formulation.

The results of these experiments are set forth in the graph of FIG. 4. As is apparent from the two upper curves, the use of Isopar carrier without the release agent resulted in carrier entrainment rates of about 0.8–1.8 grams/square meter carried past the skiv roll. In order to rule out instability effects such as discontinuous wetting due purely to the speed of operation, a spray bar was placed ahead of the skiv roll and operated to maintain a continuous excess fluid film ahead of the skiv roll. However the carrier entrainment was found to be substantially unaffected by operation of the spray bar. The optimum skiv roll speed, i.e. the speed corresponding to the least carrier uptake occurred at 55–60 inches per second, almost twice the imaging belt speed.

By contrast, when the Dow silicone oil release agent was mixed with the Isopar carrier, total transport of carrier out of the developer stage 3 was thirty to eighty-five percent lower, and remained relatively low and constant over a more extended range of skiv roll surface speeds from about forty five to about sixty inches per second.

Ceramic skiv roll spacers, in the form of precision ground annular spacer rings, were positioned at the ends of the rollers in this experiment to maintain a stable and precise 0.05 mm skiv roll to imaging surface gap, and this very small and precise spacing is believed to account for the apparent lack of effect of the spray bar, which applicant had utilized in earlier experimental set-ups to assure that there was a continuous film of a sufficient film thickness entering the skiv roll gap. On the other hand, the dramatic reduction in toner entrainment when silicone oil is added is believed to be due to a surface energy change in the toner, rather than to a change in viscosity. The Isopar L alone has a viscosity of 2.6 cStokes, and the minuscule quantity of the more viscous 20 cStoke fuser oil would not be expected to appreciably change the overall viscosity, which is a bulk fluid property. It does, however, reduce surface tension without affecting the toner's dielectric properties, and the release oil also, at the printing stage, lowers the adhesive forces between the imaged toner and the imaging belt. This latter effect is expected to result in a higher efficiency of transfer of the toned image at the transfer printing stage 6, allowing use of even lower fusing point pigment particles, and lower temperature transfer rollers at the output end, as noted above.

In general, the silicone fuser oil will enhance the transfer of liquid toner from any substrate to paper or to an intermediate belt, so printing systems embodying the invention may be drum-type systems as well as belt systems and may operate with either photoconductive or dielectric-surfaced imaging members.

The carrier uptake experiments described above were conducted with concentrations of release oil between 0.05% and 2% using a toner formulated for printing with the fluorosilicone-coated polyimide belt system as described above. With that formulation, concentrations below the lower limit had little effect, while concentrations much higher than the upper limit started to adversely effect dielectric properties of the imaging surface. However, in general the range over which release agent exerted a beneficial effect varied with the toner employed, with a level as high as seven percent remaining efective for one of the toner formulations that was evaluated.

When using a silicone or fluorosilicone imaging belt, the release agent may adhere in a thin layer to the belt, or may diffuse into and maintain replaceable volatile belt components. For this reason, the release agent is expected to diminish belt aging effects and promote transfuse release properties which remain more stable over long time periods. Experiments run using commercially available liquid toners have confirmed the general utility of adding the release agent to a commercially-compounded liquid toner to decrease the level of toner uptake during imaging.

It will be appreciated that the foregoing system achieves numerous advantages over other dry-only or liquid-only high speed printing systems. In addition to providing very low and stable carrier uptake at a relatively high surface imaging speed, the heat-softened toner image is transferred to a final substrate at a relatively low contact pressure, typically not over around 100 psi, at a lower temperature, and produces archival quality adhesion to the print, while the modified liquid toner for the initial toning step allows finer imaging than conventional dry powders, with an essentially dust-free process and little carrier uptake. In the embodiment illustrated for printing on a paper or fibrous surface, the thin elastomer provides substantially complete image transfer with little lateral deformation, and may operate with a toner having a one to two micrometer mean particle size, thus providing high quality imaging and exceptionally fine resolution.

Of course, while the described system operates by minimizing, and then removing the carrier before transfer, and therefore achieves significant energy savings as a result of the reduced entrainment, the same lowered entrainment may be expected when used in an otherwise conventional liquid-toned system in which the toned image is directly transferred to paper. In that case, a lesser amount of carrier is transferred to or soaked up by the print, reducing carrier consumption, drying requirements, or both at this later, transfer or posttransfer stage.

As for the initial reduction in carrier uptake discovered by applicant, the solution of release agent in the carrier causes the solution to wet the imaging member, and this effect is believed to be largely responsible for the thin even development layer achieved. Thus, rather than a release agent per se, a wetting agent that is known to be effective for the given carrier and/or effective for the imaging surface may be used, or a surfactant that has the necessary electrical comparability, i.e., that does not impair the insulating characteristics of the carrier, may be employed. As before, these may have a high enough boiling point so some of the added agent remains on the belt to enhance operation through its effect on surface aging of the belt, or release of dried toner.

Invention being thus described in relation to a preferred toner formulation and a representative embodiment of a print system, or sub-unit of a multi-color print system, and its construction operation and salient aspects being thus disclosed, variations and modifications will occur to those skilled in the art. All such variations are intended to be within the scope of the invention, as set forth in the claims appended hereto.

What is claimed is:

1. A printing system comprising an endless imaging member defining spatially separated successive first, second:

and third sections of said system a liquid toning assembly in said first section which applies to the imaging member a liquid toner to develop a latent charge image on said member into a toned visible image at said first section, said liquid toner including a liquid carrier, a release agent and toner particles suspended in said liquid carrier, said release agent being present in an amount effective to reduce uptake of said liquid carrier by said imaging member, a carrier removal assembly at said second section for driving off said carrier from said toned image, thereby leaving a dried toned image residing with said release agent on said imaging member, and a transfer assembly at said third section for transferring said dried toned image onto a receiving member, said imaging member cyclically returning from said third section to said first section for receiving a further liquid toned image.

2. A system according to claim 1, wherein the release agent has a surface tension less than that of the carrier and a boiling point greater than that of the carrier.

3. A system according to claim 1, wherein the carrier removal assembly vaporizes carrier and returns it to the liquid toning assembly.

4. A system according to claim 3, wherein the means for transfer ring assembly melts the toner particles and causes contact between the imaging member and a receiving member at said third section.

5. A system according to claim 1, wherein the imaging member has a surface that is non-wetting in the liquid carrier thereby further limiting transport of carrier into said second section.

6. A system according to claim 5, wherein the imaging member has at least a surface portion formed of fluorosilicone material.

7. A system according to claim 2, wherein the imaging member travels at a speed between approximately twenty-five and five hundred Feet per minute.

8. A system according to claim 1, wherein the imaging member has a low surface energy coating.

9. A printing system according to claim 1, wherein the toner particles are thermoplastic particles which are insoluble and non-swelling in the carrier.

10. A printing system according to claim 1, wherein the toner particles have a mean particle diameter in the range of approximately one to three microns.

11. A printing system according to claim 1, wherein the release agent has a viscosity greater than that of the carrier.

12. A printing system according to claim 1, wherein the third section heats the imaging member.

13. A printing system according to claim 12, further comprising at least one charge transfer print cartridge for applying a latent charge image to the imaging member.

14. A printing system according to claim 1, wherein the release agent wets the imaging member preferentially to the carrier.

15. A printing system according to claim 1 , wherein the release agent includes a silicon-containing oil.

16. A printing system according to claim 1, wherein the release agent has an affinity for the surface of said imaging member and replaces or replenishes a component thereof.

17. A toner formulation comprising a plurality of pigmented toner particles suspended in an electrically insulating carrier fluid, and an amount of a release agent dissolved in said carrier fluid, said amount being effective to reduce carrier entrainment on a latent imaging member as said latent imaging member passes through said carrier fluid.

18. A toner formulation according to claim 17, wherein the release agent has a surface tension less than the surface tension of the carrier fluid.

19. A toner formulation according to claim 18, wherein the release agent has a viscosity greater than the viscosity of the carrier fluid.

20. A toner formulation according to claim 17, wherein said release agent is selected from among silicone oil, florosilicone oil, an effective fuser oil and mixtures thereof.

21. A toner formulation according to claim 17, wherein said effective amount of release agent is between about 0.05% and 2% by weight of said carrier fluid.

22. A toner formulation according to claim 19, wherein said carrier fliud is an intert pertroleum solvent.

23. A toner formulation comprising a plurality of pigmented toner particles suspended in an electrically insulating carrier fluid, and a release agent dissolved in said fluid, the release agent having a surface tension less than that of said carrier fluid and being present in an amount effective to reduce entrainment of said carrier fluid by a charged latent imaging member.

24. A method of controlling uptake of a liquid toner by a latent imaging member, such method comprising the step of adding to the liquid toner an effective amount of an agent soluble in said liquid toner to reduce quantity of said toner adhering to the latent imaging member as it moves from an image development position.

25. The method of claim 24, wherein said agent is selected from among a release agent, a wetting agent, and a surfactant.

26. A toner formulation according to claim 17 wherein said release agent is a liquid oil.

27. A toner formulation according to claim 17 wherein said release agent is a wetting agent.

28. A toner formulation according to claim 17 wherein said release agent is a surfactant.

* * * * *